US009719365B2

(12) United States Patent
Bacic et al.

(10) Patent No.: US 9,719,365 B2
(45) Date of Patent: Aug. 1, 2017

(54) CLEARANCE CONTROL

(71) Applicant: ROLLS-ROYCE PLC, London (GB)

(72) Inventors: Marko Bacic, Oxford (GB); Timothy John Scanlon, Derby (GB); Ronald William Daniel, Oxford (GB)

(73) Assignee: ROLLS-ROYCE plc, London (GB)

( * ) Notice: Subject to any disclaimer, the term of this patent is extended or adjusted under 35 U.S.C. 154(b) by 987 days.

(21) Appl. No.: 14/031,695

(22) Filed: Sep. 19, 2013

(65) Prior Publication Data

US 2014/0112757 A1 Apr. 24, 2014

(30) Foreign Application Priority Data

Oct. 22, 2012 (GB) ..... 1218924.7
Oct. 22, 2012 (GB) ..... 1218927.0
Jan. 14, 2013 (GB) ..... 1300597.0

(51) Int. Cl.
*F01D 11/10* (2006.01)
*F01D 11/24* (2006.01)
(Continued)

(52) U.S. Cl.
CPC ..... *F01D 11/10* (2013.01); *F01D 11/06* (2013.01); *F01D 11/20* (2013.01); *F01D 11/24* (2013.01);
(Continued)

(58) Field of Classification Search
CPC ..... F01D 11/06; F01D 11/10; F01D 11/20; F01D 11/24; F01D 11/08; F05D 2270/172; F05D 2270/62; F05D 2260/16
(Continued)

(56) References Cited

U.S. PATENT DOCUMENTS 4,020,693 A 5/1977 Ahlgren et al.
8,070,424 B2 * 12/2011 Priestman ..... F15C 1/02 137/810
(Continued)

FOREIGN PATENT DOCUMENTS

EP 1 914 391 A2 4/2008
GB 2272924 A * 6/1994 ..... E21B 31/005
WO WO 2005/114013 A1 12/2005

OTHER PUBLICATIONS

Feb. 12, 2013 Search Report issued in British Patent Application No. GB1218927.0.
(Continued)

*Primary Examiner* — Woody Lee, Jr.
*Assistant Examiner* — Behnoush Haghighian
(74) *Attorney, Agent, or Firm* — Oliff PLC

(57) ABSTRACT

A clearance control device including a segment having a passage to deliver fluid towards a component rotating past the segment. Also a fluid flow device having a first fluid path coupled to the passage and a second fluid path that is decoupled from the passage. A first plasma generator is located in the fluid flow device that directs fluid towards the first fluid path; a second plasma generator is located in the fluid flow device that directs fluid towards the second fluid path; and a control arrangement is configured to alternately energize the first and second plasma generators at an energizing frequency to deliver fluid to the passage at a frequency coincident with the passing frequency of the component.

20 Claims, 5 Drawing Sheets

(51) Int. Cl.
*F01D 11/06* (2006.01)
*F01D 11/20* (2006.01)

(52) U.S. Cl.
CPC .... *F05D 2260/16* (2013.01); *F05D 2270/172* (2013.01); *F05D 2270/62* (2013.01)

(58) Field of Classification Search
USPC ..... 415/173.1–173.5, 914
See application file for complete search history.

(56) References Cited

U.S. PATENT DOCUMENTS 8,282,336 B2 * 10/2012 Wadia ..... F04D 27/001 415/1
8,317,457 B2 * 11/2012 Wadia ..... F04D 27/001 415/1
8,348,592 B2 * 1/2013 Wadia ..... F01D 5/145 415/1
8,439,634 B1 * 5/2013 Liang ..... F01D 11/10 415/115
9,145,779 B2 * 9/2015 Joe ..... F01D 9/04
2005/0109016 A1 * 5/2005 Ullyott ..... F01D 11/24 60/282
2008/0089775 A1 * 4/2008 Lee ..... F01D 11/20 415/13
2008/0121295 A1 * 5/2008 Tippetts ..... B05B 1/08 137/624.27
2009/0065064 A1 * 3/2009 Morris ..... F01D 11/20 137/2
2010/0172747 A1 * 7/2010 Clark ..... F01D 5/143 415/177
2011/0048025 A1 * 3/2011 Ginn ..... F02K 1/386 60/770
2012/0195736 A1 * 8/2012 Jothiprasad ..... F01D 11/08 415/1

OTHER PUBLICATIONS

Feb. 12, 2013 Search Report issued in British Patent Application No. GB1218924.7.
Jun. 5, 2013 Search Report issued in British Patent Application No. GB1300597.O.

* cited by examiner

CLEARANCE CONTROL

The present invention relates to an arrangement for controlling a clearance. In particular, the control arrangement of the present invention is for controlling a clearance between a rotor and a stationary casing in a gas turbine engine, or between a stator vane and rotating rims in a gas turbine engine, or in a seal arrangement. The present invention will be described with respect to a gas turbine engine for powering an aircraft, although other applications are envisaged.

A gas turbine engine 10 is shown in FIG. 1 and comprises an air intake 12 and a propulsive fan 14 that generates two airflows A and B. The gas turbine engine 10 comprises, in axial flow A, an intermediate pressure compressor 16, a high pressure compressor 18, a combustor 20, a high pressure turbine 22, an intermediate pressure turbine 24, a low pressure turbine 26 and an exhaust nozzle 28. A nacelle 30 surrounds the gas turbine engine 10 and defines, in axial flow B, a bypass duct 32.

Each of the fan 14, compressors 16, 18 and turbines 22, 24, 26 comprise one or more rotor stages having blades radiating from a hub. The blades are surrounded by a casing which may be formed of segments. It is necessary to have a small gap between the radially outer tips of the blades and the surrounding casing so that there is a running clearance between the components. The casing and blades are subject to radial growth due to heating and centrifugal forces during engine running. The casing and blades grow radially at different rates, dependent on their mass, shape and other factors, and therefore the gap between the blade tips and the casing varies during the engine run cycle.

For the gas turbine engine 10 to be efficient, it is desirable to minimise the gap between the radially outer tips of the blades and the surrounding casing since air that leaks through this gap does not do work on the subsequent turbine stage or is not compressed by the compressor stage. Nevertheless, it is also desirable to prevent blade tip rub against the casing which damages the components, thereby shortening their lives, and may introduce vibration into the rotor stage.

It is known to control the blade tip clearance gap size by active or passive methods. For example, relatively cool air may be supplied to the casing to reduce its radial dimension during a cruise phase of the flight cycle. Mechanical actuation of portions of the casing to move them radially inwardly or outwardly may also be used to change the gap between the blade tips and the casing.

One problem with known methods of controlling the blade tip clearance is that they are unable to respond quickly enough to changes experienced during transient manoeuvres, such as slam accelerations. Known methods and devices may also be bulky and/or complex. Where devices use mechanical actuation, it is difficult to provide components having a sufficient life to be cost-effective since there may be as many as 30,000 individual movements of the components during a single long-haul flight (8 hour duration).

The present invention provides a blade tip clearance control device that seeks to address the aforementioned problems.

Accordingly the present invention provides a clearance control device comprising: a segment having a passage to deliver fluid towards a component rotating past the segment; a fluid flow device having a first fluid path coupled to the passage and a second fluid path that is decoupled from the passage; a first plasma generator located in the fluid flow device that directs fluid towards the first fluid path; a second plasma generator located in the fluid flow device that directs fluid towards the second fluid path; and a control arrangement configured to alternately energise the first and second plasma generators at an energising frequency to deliver fluid to the passage at a frequency coincident with the passing frequency of the component.

Advantageously the clearance control device acts more quickly than known arrangements and comprises no moving mechanical parts. Also advantageously the clearance control device uses less fluid than known devices.

The fluid flow device may be a switched vortex valve. The second fluid path may close the valve. Alternatively the fluid flow device may comprise a bifurcated fluid passage.

The first and second plasma generators may be located at an inlet to the fluid flow device. The first and second plasma generators may be spaced apart across a fluid path into the fluid flow device to act on the fluid flow in opposite directions.

The first and/or second plasma generators may each comprise a pair of electrical terminals separated by a gap across which a spark may travel to generate plasma. The first and/or second plasma generators may each comprise a dielectric barrier discharge actuator to generate plasma. The first plasma generator may have a different form to the second plasma generator.

The passage may be angled to deliver fluid at least partially in the opposite direction to fluid passing between the component and the segment. The passage may form an angle of 1° to 90° to the plane of the segment facing the component. The passage may form an angle of 30° to 60° to the plane of the segment facing the component. Advantageously, such angling of the passage promotes creation of a vortex in the clearance between the segment and the component.

There may be a sensor coupled to the control arrangement, the sensor arranged to sense the passing frequency of the component. The energising frequency may be coincident with the passing frequency of the component. The control arrangement may be arranged to energise the first and second plasma generators for unequal periods. Advantageously, the clearance control device therefore supplies fluid only when the component is passing the passage and not when there is a gap aligned with the passage. The control arrangement may be arranged to energise the second plasma generator for twice as long as the first plasma generator. The control arrangement may be arranged to energise the first plasma generator for around 30 μs.

The device may further comprise a Hartmann oscillator coupled between the first fluid path and the passage, wherein the Hartmann oscillator may be arranged to receive inlet flow from the first fluid path and deliver output flow to the passage. The energising frequency may modulate amplitude of the inlet flow to the Hartmann oscillator such that the output flow from the Hartmann oscillator includes a frequency coincident with the passing frequency of the component. Advantageously the inclusion of a Hartmann oscillator provides a robust and quick arrangement to deliver fluid to the passage at the passing frequency of the component without moving parts.

The device may further comprise a fluid filter arranged to receive the output flow from the Hartmann oscillator and to deliver filtered fluid to the passage. Advantageously, the delivered filtered fluid has a reduced number of frequencies because some harmonics are filtered out. Beneficially the more attenuated frequencies are filtered.

The segment may comprise at least two passages.

The present invention also provides a rotor sub-assembly comprising a rotor having an array of blades, a casing segment surrounding the rotor blades and a device as described wherein the component comprises a blade of the array of blades.

The present invention also provides a seal arrangement comprising the device as described, wherein the segment comprises a seal segment and the component comprises a rotating component against which the seal acts.

The present invention also provides a gas turbine engine comprising a device as described, a rotor sub-assembly as described or a seal arrangement as described.

Any combination of the optional features is encompassed within the scope of the invention except where mutually exclusive.

The present invention will be more fully described by way of example with reference to the accompanying drawings, in which.

Figure 1:
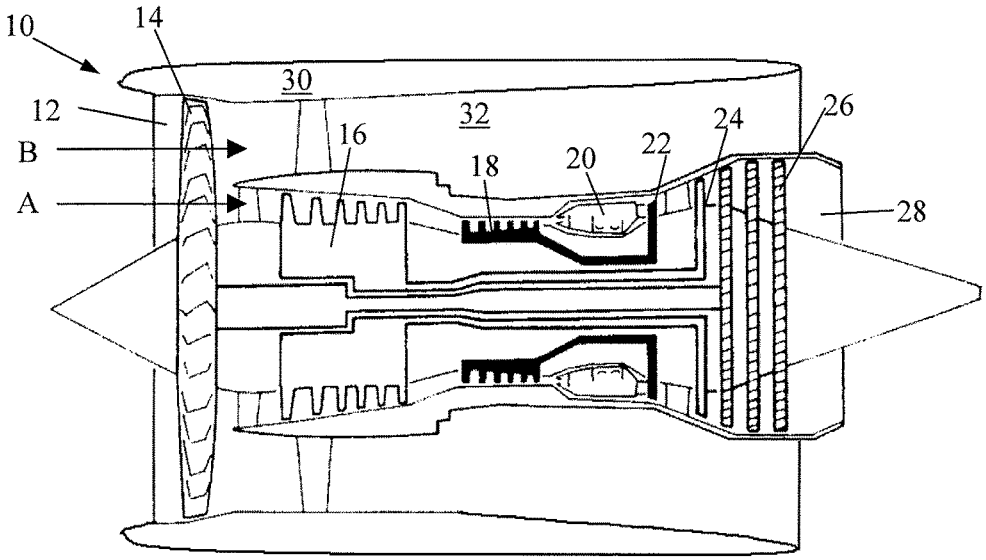
FIG. 1 is a sectional side view of a gas turbine engine.
Figure 2:
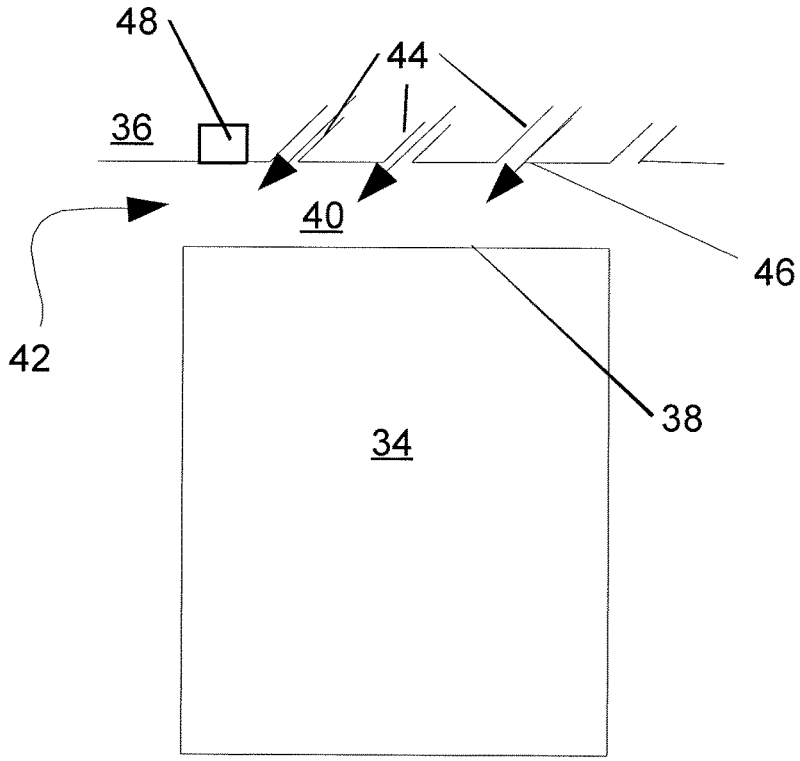
FIG. 2 is a schematic axial section through a blade and segment to which a clearance control device according to the present invention may be applied.

FIG. 2 shows part of the device of the present invention. A blade 34, which is one of a circumferential array about a hub (not shown), is located radially inwardly of a casing segment 36. The blade 34 has a tip 38 at its radially outer edge. Between the blade tip 38 and the segment 36 is a clearance 40 through which air leaks as shown by arrow 42. The segment 38 includes a plurality of passages 44 through which injection air is delivered as shown by arrows 46. Preferably the passages 44 form an angle $\alpha$ with the plane surface of the segment 36 that defines part of the clearance 40. The angle $\alpha$ may be 1° to 90°, more preferably 30° to 60°. The passages 44 are angled so that the injection air is delivered in a direction that substantially opposes the direction of flow of the leakage air 42. As illustrated, the leakage air 42 travels from left to right and the injection air 46 has an element that travels from right to left.

The angle $\alpha$ is chosen for each specific application of the present invention so that the injection air 46 forms vortices in the clearance 40. The vortices act to substantially block the clearance 40 so that the leakage air 42 is unable to pass through the clearance 40. Instead the leakage air 42 is forced to pass over the blade 34 and do useful work, thereby improving the efficiency of the engine 10.

As will be apparent to the skilled reader, the array of blades rotates at a speed from which the passing frequency can be calculated. The passing frequency is the period with which a specified point on consecutive blades 34 passes a specified point on the segment 36. There may be a sensor 48 positioned on the segment 36 to sense the passing of each blade 34. The signal from the sensor 48 can then be processed to determine the passing frequency of the blades 34 which can be passed to a control arrangement.

The injection air 46 may be supplied from a variety of sources. However, it may typically be air bled from an upstream compressor stage. The efficiency gain from supplying injection air 46 to form vortices in the clearance 40 must be weighed against the efficiency drop from extracting working air from the compressor stages to supply as injection air 46. The amount of injection air 46 can be reduced by supplying injection air 46 through the passages 44 only when a blade 34 is circumferentially aligned with the passages 44 and cutting off the supply in the period between blades 34 passing.

For a turbine stage rotating at approximately 10,000 rpm the passing frequency of the blade tips 38 is approximately 10 kHz and therefore the period is approximately 100 μs. A blade 34 passes the passages 44 for approximately ⅓ of this time, 33 μs, due to its width. Thus injection air 46 can most efficiently be supplied for 33 μs and then stopped for 66 μs, coincident with the passing of the blades 34 forming the array.

The segment 36 will preferably comprise a circumferential array of passages 44 so that injection air 46 can be supplied to form vortices in the clearance 40 above more than one blade tip 38 in the array of blades 34. More preferably, there will be more passages 44 than there are blades 34 in the array of blades 34 and the passages 44 will be distributed with denser circumferential spacing than the blades 34 so that injection air 46 can be supplied to the clearance 40 above all the blade tips 38 simultaneously. Alternatively, the circumferential array of passages 44 may be arranged so that vortices are formed above subsets of the array of blades 34 in a defined sequence. Alternatively there may be the same number of passages 44 in the circumferential array as there are blades 34.

There may be an axial array of passages 44 aligned with each passage 44 in the circumferential array. Alternatively, axially adjacent circumferential arrays may be circumferentially offset. The passages 44 may be coupled to a supply manifold (not shown) that supplies the injection air 46, or more than one manifold each of which supplies a subset of the passages 44.

Figure 3:
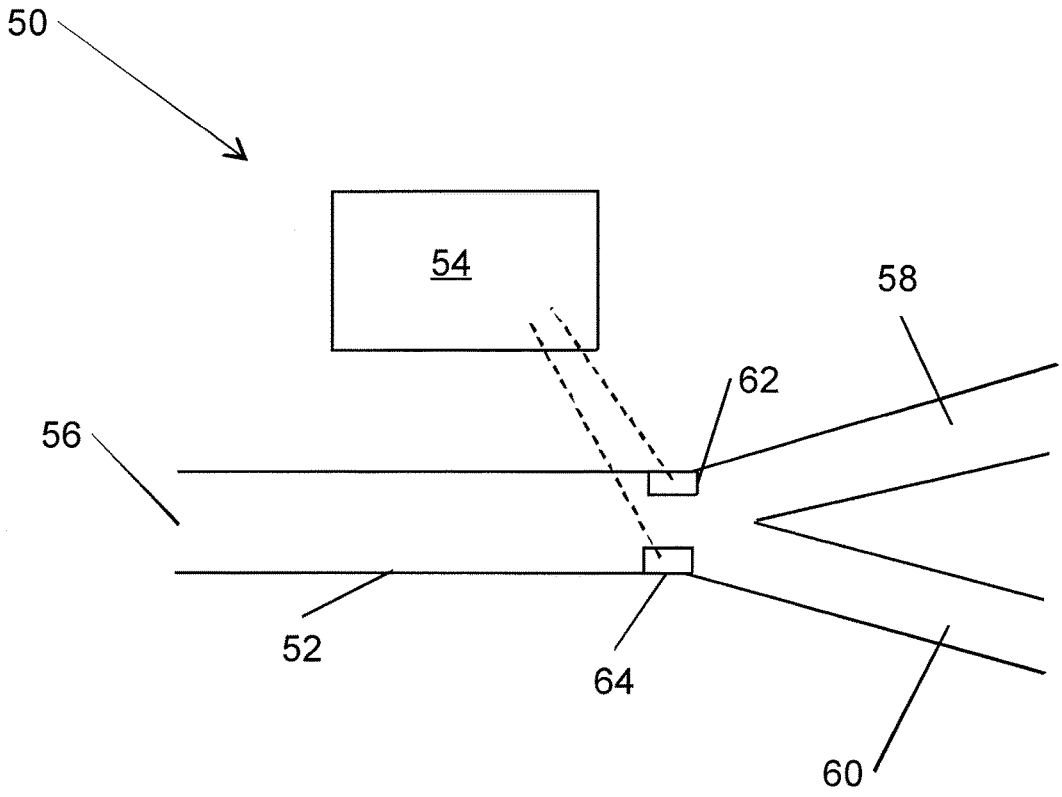
FIG. 3 is a schematic illustration of a clearance control device according to the present invention.

FIG. 3 shows further aspects of the present invention. A clearance control device 50 according to the present invention comprises a fluid flow device 52 and a control arrangement 54. The fluid flow device 52 has an inlet 56 coupled to a first fluid path 58 and a second fluid path 60. The first fluid path 58 is coupled to the passage or passages 44 for delivery of injection air 46 to the clearance 40 between the segment 36 and a passing blade tip 38. The second fluid path 60 is decoupled from the passage or passages 44 so that air is not delivered for injection to the clearance 40.

For each segment 36 there will preferably be a single clearance control device 50 that controls one fluid flow device 52 to feed all the passages 44 through that segment 36. Alternatively a single clearance control device 50 may feed multiple fluid flow devices 52, each of which supplies a single passage 44 or a subset of the passages 44 through the segment 36. In a further alternative, more than one clearance control device 50 may be provided in each segment 36 to control one or more fluid flow devices 52 each supplying one or more passages 44 through the segment 36. Thus an engine 10 having multiple segments 36 forming the casing has at least as many clearance control devices 50 as there are segments 36 in one aspect of the present invention.

A clearance control device 50 may be arranged to control fluid flow devices 52 on more than one segment 36.

The clearance control device 50 comprises a first plasma generator 62 and a second plasma generator 64. The first plasma generator 62 is located in the fluid flow device 52 and is arranged to direct fluid, when energised, towards the first fluid path 58. The second plasma generator 64 similarly is located in the fluid flow device 52 and is arranged to direct fluid, when energised, towards the second fluid path 60. The first plasma generator 62 and the second plasma generator 64 are preferably located the same distance from the inlet 56 entrance and/or the same distance from the first fluid path 58 and second fluid path 60 respectively. The first plasma generator 62 and the second plasma generator 64 may be located on diametrically opposite sides of a substantially cylindrical inlet 56 or equivalently spaced apart where the fluid flow device 52 has a different shape.

Advantageously, using plasma generators 62, 64 provides more rapid actuation than previously known actuators since no mechanical parts move to effect the actuation. Furthermore, the fluid flow device 52 can be arranged to amplify the diversion of the fluid flow therethrough so that relatively small actuators may be used and yet have a sufficiently large effect on the output.

The control arrangement 54 is arranged to energise the first plasma generator 62 and the second plasma generator 64 with the control signals indicated by dotted lines. The control arrangement 54 energises the plasma generators 62, 64 alternately and may energise them asymmetrically, that is for unequal periods, as discussed above to supply injection air 46 when a blade 34 is passing the passages 44 and not when no blade 34 is passing. Thus the plasma generators 62, 64 are energised at an energising frequency so that fluid is delivered to the passages 44 at a frequency coincident with the passing frequency of the blades 34.

Figure 4:
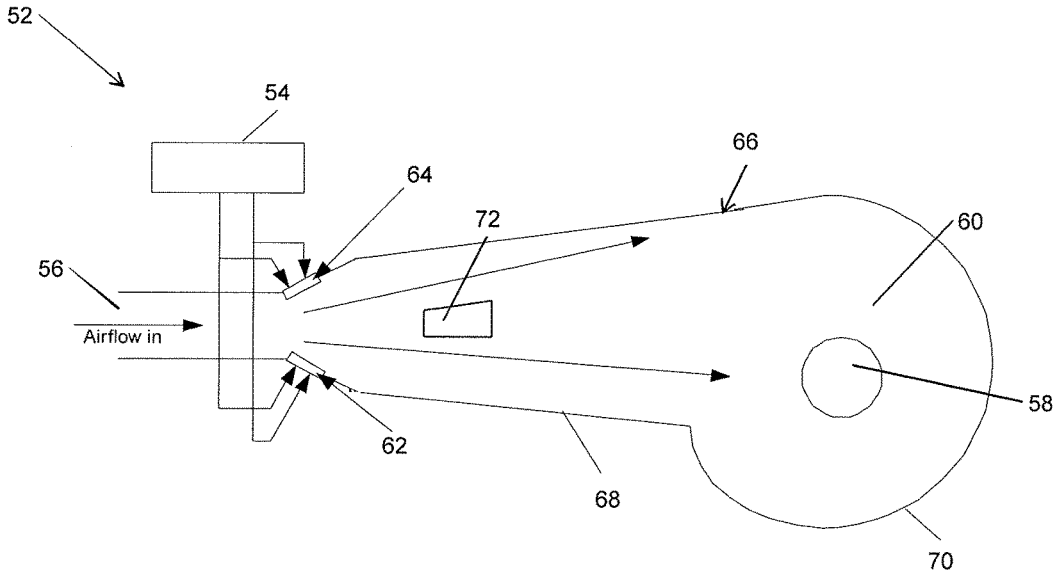
FIG. 4 is a schematic illustration of an alternative fluid flow device.

As illustrated in FIG. 3, the fluid flow device 52 may be in the form of a bifurcated fluid passage having one inlet 56 and two outlet fluid paths 58, 60. Alternatively, the fluid flow device 52 may be a switched vortex valve 66 as illustrated in FIG. 4. The switched vortex valve 66 has an inlet 56 into which air is supplied. The main body of the switched vortex valve 66 comprises an asymmetric tube 68 and a cylindrical end portion 70. There may be a diverter 72 located in the tube 68 such that air flow can be directed to one side or the other of the diverter 72 as will be described. A central passage forms the first fluid path 58 whilst the periphery of the end portion 70 forms the second fluid path 60.

The first plasma generator 62, when energised at the energising frequency, diverts the air flowing into the fluid flow device 52 through the inlet 56 into tube 68. The air passes below the diverter 72, as illustrated, and into the middle of the end portion 70 which forms the first fluid path 58 which is coupled to the passage or passages 44 in the segment. Typically the air flow is turned through up to 90° between the tube 68 through the switched vortex valve and the passage 44. The second plasma generator 64, when energised at the energising frequency, diverts the air above the diverter 72, as illustrated, and along the edge of the tube 68 so that it is guided to circulate around the periphery of the end portion 70 which forms the second fluid path 60. This causes the air to form a vortex in the end portion 70 which acts to close the switched vortex valve 66.

Figure 5:
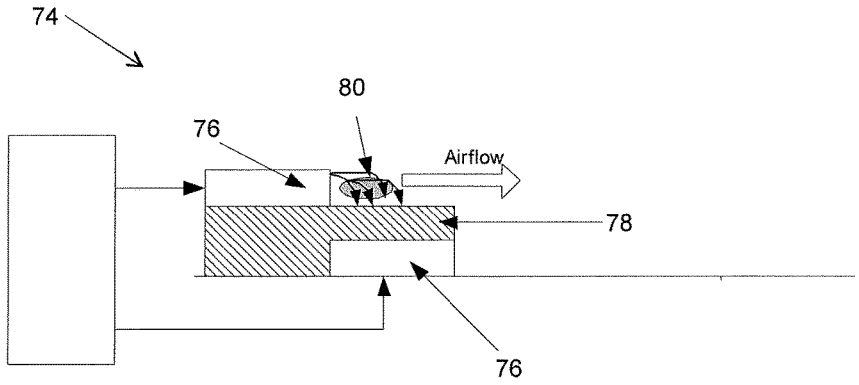
FIG. 5 is a schematic diagram of a dielectric barrier discharge actuator.

In one aspect of the present invention the first and second plasma generators 62, 64 each comprise a dielectric barrier discharge actuator 74, a schematic of which is illustrated in FIG. 5. As is known to the skilled reader, a dielectric barrier discharge actuator 74 comprises a pair of electrodes 76 separated by a dielectric 78. The dielectric barrier discharge actuator 74 forms plasma 80 when a voltage is applied across the electrodes 76. The plasma 80 ionises airflow past it and thereby diverts the path of the air.

Figure 6:
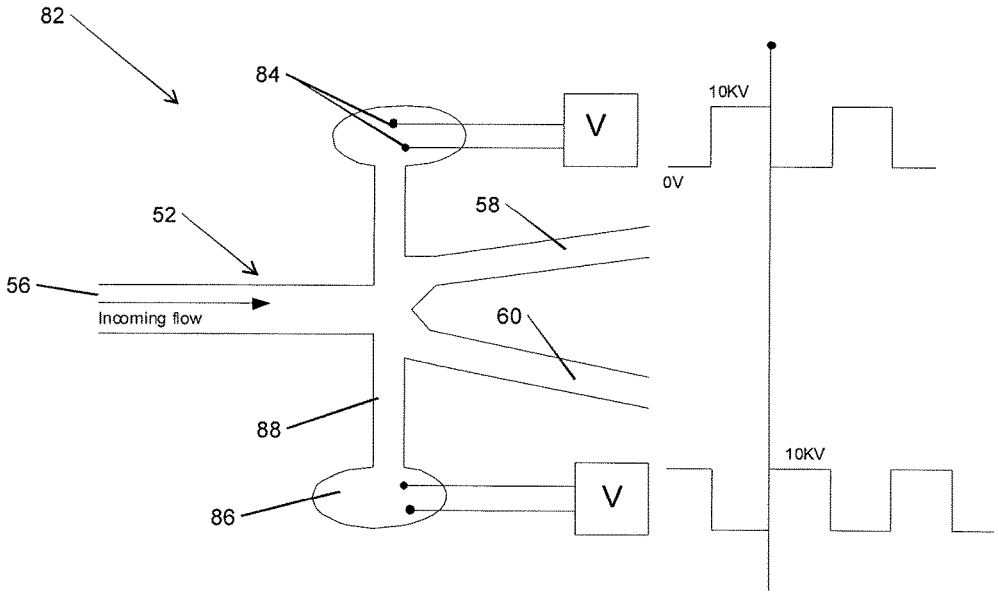
FIG. 6 is a schematic illustration of a spark gap arrangement.
Figure 7:
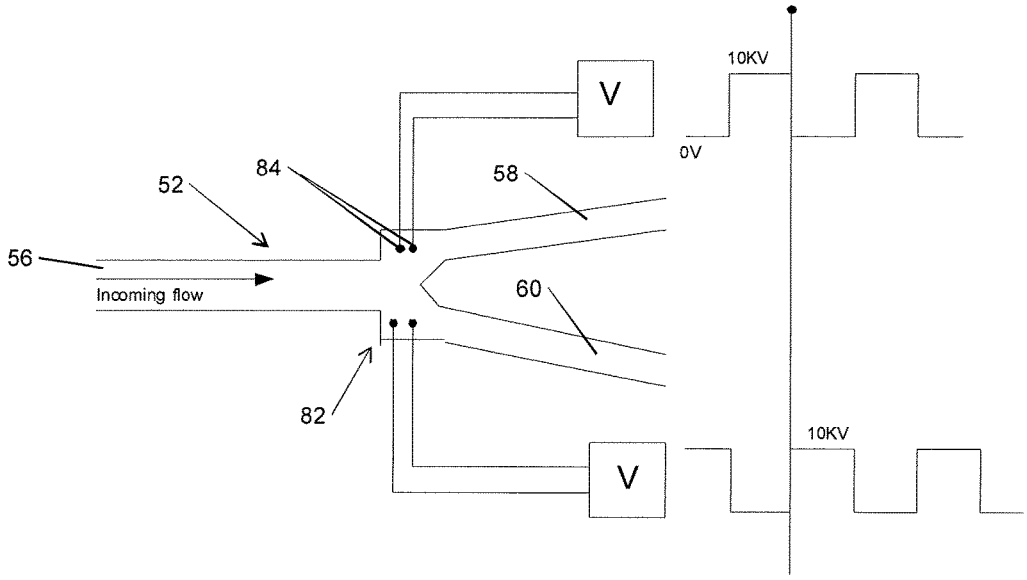
FIG. 7 is a schematic illustration of another spark gap arrangement.

In another aspect of the present invention the first and second plasma generators 62, 64 each comprise a spark gap arrangement 82 as illustrated in FIG. 6 and FIG. 7. The spark gap arrangement 82 comprises a pair of terminals 84 across which a voltage can be applied. The spark generated across the gap between the terminals 84 superheats the air thereby creating a plasma which causes a pressure wave to act on the air flowing through the fluid flow device 52 to divert it to the first or second fluid path 58, 60. In FIG. 6 there are two spark gap arrangements 82, each located in closed chambers 86 coupled to the junction between the inlet 56, first fluid path 58 and second fluid path 60 by passages 88. In FIG. 7 there are two spark gap arrangements 82, one located in the junction between the inlet 56 and the first fluid path 58 and one located in the junction between the inlet 56 and the second fluid path 60.

Each of the embodiments of the first and second plasma generators 62, 64 acts to disrupt the entrainment region of the fluid which causes it to attach to a wall. The various arrangements discussed act to detach the fluid from one wall and permit it to reattach to another wall thereby redirecting the flow from the first fluid path 58 to the second fluid path 60 or vice versa. A dielectric barrier discharge actuator 74 acts to 'pull' the fluid flow towards the activated plasma generator whereas a spark gap arrangement 82 acts to 'push' the fluid flow away from the activated plasma generator. Thus it is possible for the first plasma generator 62 to be dielectric barrier discharge actuator 74 and the second plasma generator 64 to be a spark gap arrangement 82. In this embodiment the first and second plasma generators 62, 64 must be located adjacent to each other and not be diametrically spaced so that they act on the fluid flow in opposite directions.

Figure 8:
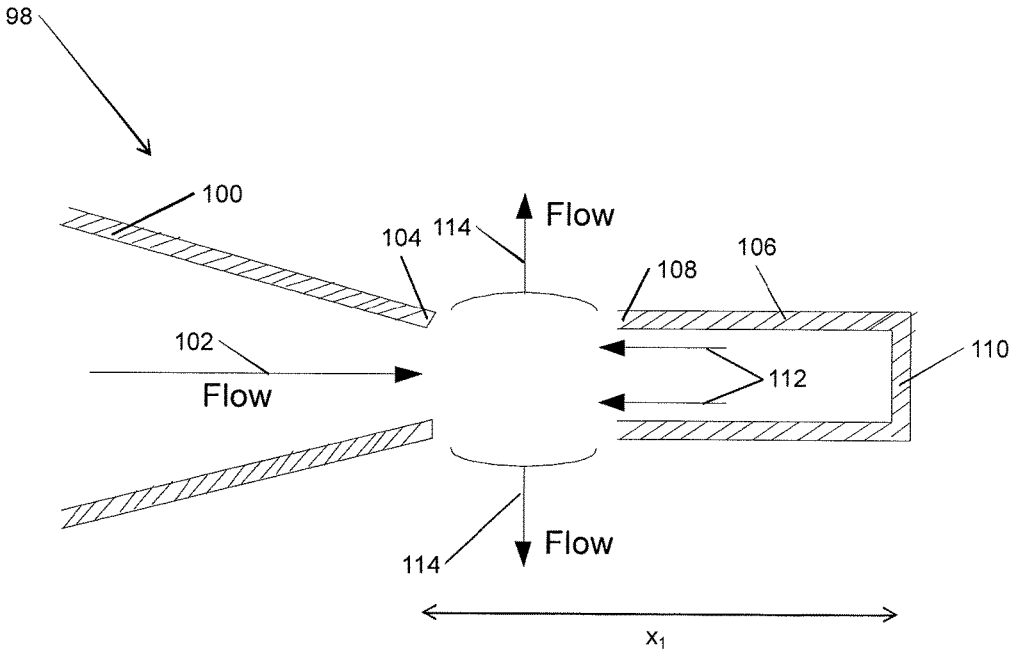
FIG. 8 is a known Hartmann oscillator.

A Hartmann oscillator 98 is shown in FIG. 8. The Hartmann oscillator 98 comprises a fluid nozzle 100 through which fluid is delivered. The fluid nozzle 100 may have a convergent shape so that the fluid jet shown by arrow 102 issuing from its exit 104 is unexpanded. The Hartmann oscillator 98 also comprises a tube 106 spaced apart from the fluid nozzle 100 and having a common longitudinal axis with it. In the simplest arrangement the tube 106 is cylindrical. The tube 106 has an open end 108 which faces the exit 104 of the fluid nozzle 100 and a closed end 110. The effective length $x_1$ of the Hartmann oscillator 98 is the distance between the exit 104 of the fluid nozzle 100 and the closed end 110 of the tube 106. The closed end 110 of the tube 106 reflects fluid, as shown by arrows 112, issued from the exit 104 of the fluid nozzle 100 towards the space between the tube 106 and the fluid nozzle 100. The interaction of the reflected fluid 112 from the tube 106 and more fluid 102 being issued from the exit 104 of the fluid nozzle 100 causes fluid to be ejected radially as shown by arrows 114.

Figure 9:
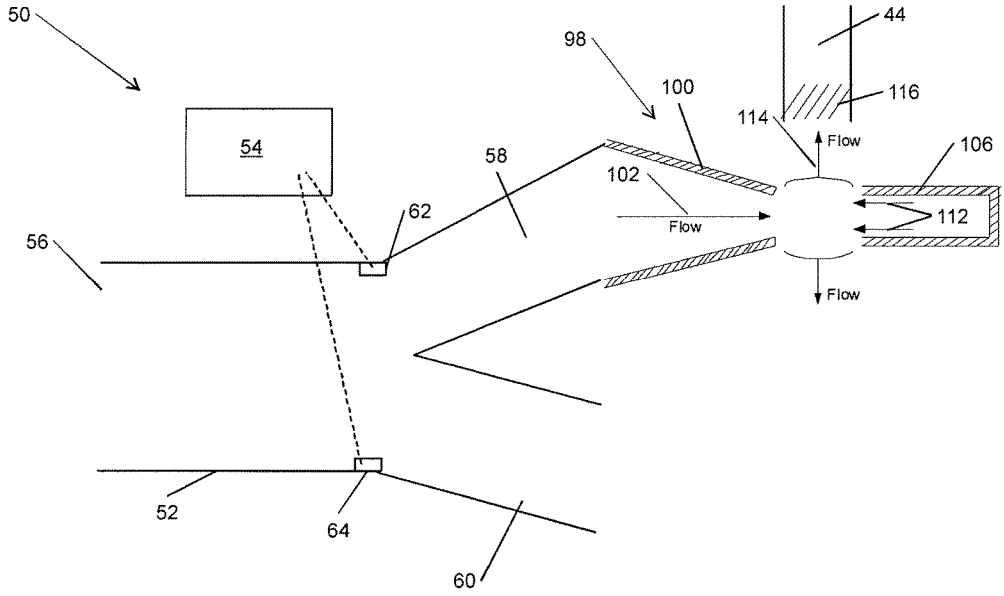
FIG. 9 is a schematic illustration of a clearance control device according to the present invention in combination with a Hartmann oscillator.

FIG. 9 shows the inclusion of a Hartmann oscillator 98 into the fluid flow device 52 according to the present invention. Specifically, the Hartmann oscillator 98 is coupled between the first fluid path 58 and the passage 44. The fluid jet 102 comprises a main fluid flow frequency, for example 12 kHz. The fluid that flows from the first fluid path 58 into the fluid nozzle 100 of the Hartmann oscillator 98 acts to modulate the amplitude of the inlet flow, fluid jet 102. For example, the control arrangement 54 is arranged to energise the first and second plasma generators 62, 64 alternately at an energising frequency of 1 kHz to 3 kHz to provide modulation into the inlet flow 102. Taking the example of the energising frequency 1 kHz, this has the effect that the output flow 114, that is subsequently directed into and through the passage 44, has its frequency modulated to have components at 11 kHz and 13 kHz. Advantageously 11 kHz coincides with the passing frequency of the blades 34 in particular applications of the clearance control device 50 of the present invention.

It will be apparent to the skilled reader that each of the main fluid flow frequency and the energising frequency can be set to different values in different applications so that one of the frequency components of the output flow 114 is coincident with the passing frequency of the blades 34.

Optionally a fluidic filter 116 may be coupled between the Hartmann oscillator 98 and the passage 44 so that the output flow 114 passes through the fluidic filter 116. The filter 116 thus acts to attenuate or remove one or more frequencies of the output flow 114 so that only flow at a frequency coincident with the passing frequency of the blades 34 is supplied to the passage 44. For example, a fluidic filter 116 can be arranged to attenuate or remove the 13 kHz component of the output flow 114 leaving only the 11 kHz component. Where the input modulation from the clearance control device 50 has the form of a square wave there are additional harmonic frequencies in the output flow 114, albeit of reducing amplitude the greater the harmonic. A fluidic filter 116 may be applied to the output flow 114 to attenuate all frequencies at or above 13 kHz, for example 13 kHz, 15 kHz and 17 kHz, to leave just 11 kHz and below. A second fluidic filter 116 may be applied to the output flow 114 to also remove frequencies below 11 kHz.

Figure 10:
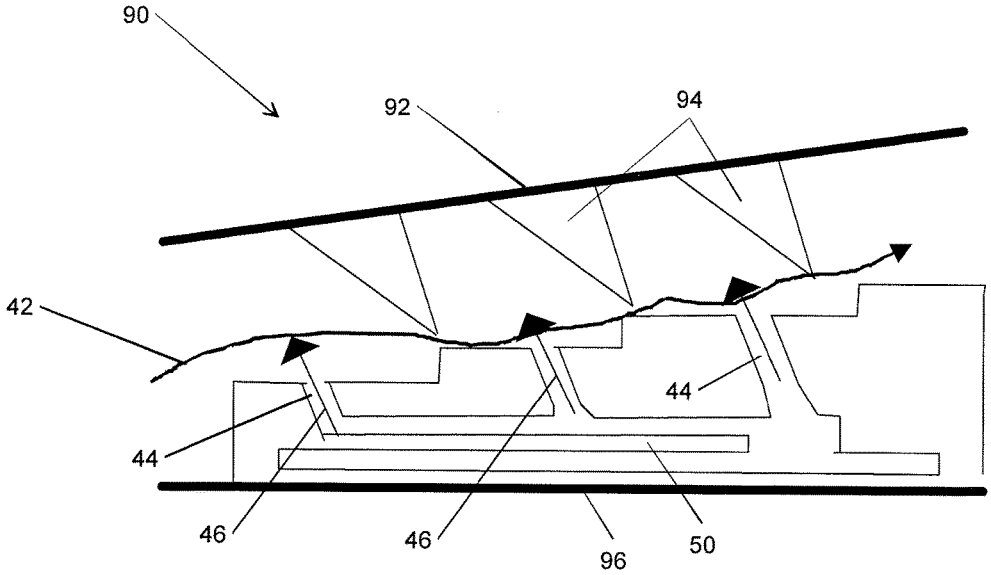
FIG. 10 is a schematic illustration of a seal arrangement to which a clearance control device according to the present invention may be applied.

The present invention has been described for blocking leakage air 52 from flowing through the clearance 40 between blade tips 38 and the casing segment 36 surrounding a rotor stage of a gas turbine engine 10. However, the present invention also finds utility for a seal arrangement 90 as illustrated in FIG. 10. The seal arrangement 90 comprises a seal segment 92 that includes a plurality of seal members 94 in sealing abutment to a rotating component 96. Leakage air flows through the seal as indicated by arrow 42. In accordance with the present invention, a clearance control device 50 is provided to deliver injection air 46 to passages 44 through the seal segment 92 and thence to block the leakage air 42.

Advantageously the present invention permits air to be modulated deep inside an engine 10. The present invention may be used for bore flow modulation or for modulation of air flow in other parts of the air system. Alternatively the present invention may be used to modulate other fluids in fluid systems.

The invention claimed is:

1. A clearance control device comprising:

a segment having a passage to deliver fluid towards a component rotating past the segment;

a fluid flow device having a first fluid path coupled to the passage and a second fluid path that is decoupled from the passage;

a first plasma generator located in the fluid flow device that directs fluid towards the first fluid path;

a second plasma generator located in the fluid flow device that directs fluid towards the second fluid path; and a control arrangement configured to alternately energise the first and second plasma generators at an energising frequency, to deliver fluid to the passage at a frequency coincident with the passing frequency of the component.

2. The clearance control device as claimed in claim 1 wherein the fluid flow device comprises a switched vortex valve.

3. The clearance control device as claimed in claim 2 wherein the second fluid path closes the valve.

4. The clearance control device as claimed in claim 1 wherein the fluid flow device comprises a bifurcated fluid passage.

5. The clearance control device as claimed in claim 1 wherein the first and second plasma generators are located at an inlet to the fluid flow device.

6. The clearance control device as claimed in claim 5 wherein the first and second plasma generators are spaced apart across a fluid path into the fluid flow device.

7. The clearance control device as claimed in claim 1 wherein the first and second plasma generators each comprise a pair of electrical terminals separated by a gap across which a spark may travel to generate plasma.

8. The clearance control device as claimed in claim 1 wherein the first and second plasma generators each comprise a dielectric barrier discharge actuator.

9. The clearance control device as claimed in claim 1 wherein the passage is angled to deliver the fluid in the opposite direction to fluid passing between the component and the segment.

10. The clearance control device as claimed in claim 9 wherein the passage forms an angle ($\alpha$) of 1° to 90° to the plane of the segment facing the component.

11. The clearance control device as claimed in claim 1 further comprising a sensor coupled to the control arrangement, the sensor arranged to sense the passing frequency of the component.

12. The clearance control device as claimed in claim 1 wherein the energising frequency is coincident with the passing frequency of the component.

13. The clearance control device as claimed in claim 1 further comprising a Hartmann oscillator coupled between the first fluid path and the passage, wherein the Hartmann oscillator is arranged to receive inlet flow from the first fluid path and deliver output flow to the passage.

14. The clearance control device as claimed in claim 13 wherein the energising frequency modulates amplitude of the inlet flow to the Hartmann oscillator such that the output flow from the Hartmann oscillator includes a frequency coincident with the passing frequency of the component.

15. The clearance control device as claimed in claim 13 further comprising a fluid filter arranged to receive the output flow from the Hartmann oscillator and to deliver filtered fluid to the passage.

16. The clearance control device as claimed in claim 1 wherein the control arrangement is arranged to energise the first and second plasma generators for unequal periods.

17. The clearance control device as claimed in claim 1, wherein the segment comprises at least two passages.

18. A rotor sub-assembly comprising a rotor having an array of blades, a casing segment surrounding the rotor blades and the clearance control device as claimed in claim 1 wherein the component comprises a blade of the array of blades.

19. A seal arrangement comprising the clearance control device as claimed in claim 1 wherein the segment comprises a seal segment (and the component comprises a rotating component against which the seal acts.

20. A gas turbine engine comprising the clearance control device as claimed in claim 1.

* * * * *